US006477997B1

(12) United States Patent
Wakeman

(10) Patent No.: US 6,477,997 B1
(45) Date of Patent: Nov. 12, 2002

(54) APPARATUS FOR CONTROLLING THE OPERATION OF A VALVE IN AN INTERNAL COMBUSTION ENGINE

(75) Inventor: Russell J. Wakeman, Canton, MI (US)

(73) Assignee: Ricardo, Inc., Belleville, MI (US)

( * ) Notice: Subject to any disclaimer, the term of this patent is extended or adjusted under 35 U.S.C. 154(b) by 0 days.

(21) Appl. No.: 10/047,232

(22) Filed: Jan. 14, 2002

(51) Int. Cl.[7] ..... F01L 13/00

(52) U.S. Cl. ..... 123/90.16; 123/90.45; 123/90.55; 123/198 F

(58) Field of Search ..... 123/90.11, 90.12, 123/90.15, 90.16, 90.39, 90.41, 90.45, 90.48, 90.49, 90.55, 198 F

(56) References Cited

U.S. PATENT DOCUMENTS

| | | | | |
|---|---|---|---|---|
| 4,111,165 | A | | 9/1978 | Aoyama et al. |
| 4,112,884 | A | | 9/1978 | Tominaga |
| 4,258,671 | A | | 3/1981 | Takizawa et al. |
| 4,452,187 | A | | 6/1984 | Kosuda et al. |
| 4,469,061 | A | | 9/1984 | Ajiki et al. |
| 4,615,306 | A | | 10/1986 | Wakeman |
| 4,671,221 | A | | 6/1987 | Geringer et al. |
| 4,696,265 | A | | 9/1987 | Nohira |
| 4,711,207 | A | | 12/1987 | Bonvallet |
| 4,930,465 | A | | 6/1990 | Wakeman et al. |
| 5,544,628 | A | * | 8/1996 | Voigt ..... 123/90.16 |
| 5,558,052 | A | | 9/1996 | Schwarzenthal et al. |
| 6,053,133 | A | | 4/2000 | Faria et al. |
| 6,125,804 | A | | 10/2000 | Kawai et al. |
| 6,220,212 | B1 | | 4/2001 | Wakeman |
| 6,223,706 | B1 | | 5/2001 | Maas et al. |
| 6,227,154 | B1 | * | 5/2001 | Wakeman ..... 123/90.16 |
| 6,273,039 | B1 | | 8/2001 | Church |
| 6,293,239 | B1 | * | 9/2001 | Herbst ..... 123/90.16 |
| 6,302,070 | B1 | | 10/2001 | Tsukui et al. |
| 6,318,318 | B1 | * | 11/2001 | Jahr ..... 123/90.16 |
| 6,325,030 | B1 | * | 12/2001 | Spath et al. ..... 123/90.16 |
| 6,425,358 | B1 | * | 7/2002 | Haas et al. ..... 123/90.16 |

* cited by examiner

*Primary Examiner*—Weilun Lo
(74) *Attorney, Agent, or Firm*—MacMillan, Sobanski & Todd, LLC

(57) ABSTRACT

A control apparatus for deactivating one of an intake valve and an exhaust valve in an internal combustion engine has a stepped sleeve slidably receiving a valve stem in a smaller diameter portion and a rocker piston in a larger diameter portion. Hydraulic fluid is retained in the sleeve and a clamping block is positioned adjacent the exterior of the larger diameter portion. When the clamping block is activated to engage the sleeve, the sleeve remains stationary as reciprocating movement of the rocker piston causes the valve to open and close. When the clamping block is not activated, the sleeve is free to move with the piston leaving the engine valve closed.

19 Claims, 4 Drawing Sheets

APPARATUS FOR CONTROLLING THE OPERATION OF A VALVE IN AN INTERNAL COMBUSTION ENGINE

BACKGROUND OF THE INVENTION

The present invention relates generally to valve deactivating devices for internal combustion engines and, in particular, to an apparatus for controlling the operation of a valve in an internal combustion engine.

Internal combustion engines are well known. Internal combustion engines include a valvetrain having intake and exhaust valves disposed in the cylinder head above each combustion cylinder. The intake and exhaust valves connect intake and exhaust ports with each combustion cylinder. The intake and exhaust valves are generally poppet-type valves having a generally mushroom-shaped head and an elongated cylindrical stem extending from the valve head. A spring biases the valve head in a fully closed position against a valve seat in the cylinder head. Historically, engine valves were actuated from the fully closed position to a fully open position by an underhead camshaft, pushrod, and rocker arm assembly. Hydraulic lifters, which utilize pressurized hydraulic fluid to actuate a piston to reciprocate the valve, were added as a buffer between the motion of the rocker arm and the valve stem and as a means for adjusting valve lash. In later developments, overhead camshafts eliminated the pushrod and, occasionally, the rocker arm for a more direct actuation of the valves.

Devices for deactivating engine valves, known in the art as lost motion devices, are also well known. Lost motion devices are advantageous because they increase the efficiency of the engine by either completely eliminating or reducing the stroke of the valve, thereby allowing no or reduced fuel-air mixture or engine exhaust, respectively, to enter or exit the cylinder respectively. Prior art lost motion devices have utilized different means to deactivate the valve including varying the output of the hydraulic fluid pump and reducing the force of the lifter. Other prior art lost motion devices utilized solenoid valves to control when lifters were active or inactive. Regardless of the means for deactivating the engine valve, most modern lost motion devices are activated by a control means that determines when the means for deactivating the valve is to be engaged or disengaged.

Prior art hydraulic lost motion devices, however, do have disadvantages. Many prior art lost motion devices have only two positions, either engaged, whereby the valve completes a full stroke, or disengaged, whereby the valve does not complete a stroke at all, rendering that particular cylinder inactive for that engine cycle. In addition, prior art lost motion devices have losses associated with the hydraulic system and require a separate accumulator to recover the hydraulic energy. Another limitation of prior art lost motion devices has been their inability to produce the equivalent of cam ramp motion, accelerating and decelerating the valves slowly enough to prevent valve bounce, wear, noise, and high Hertz stresses.

The art continues to seek improvements. It is desirable to provide an apparatus for controlling the operation of a valve in the internal combustion engine that does not have losses associated with prior art hydraulic systems. It is also desirable to provide an apparatus for controlling the operation of a valve in the internal combustion engine that can prevent valve bounce, wear, noise and high Hertz stresses, and that has more than two positions.

SUMMARY OF THE INVENTION

The present invention concerns an apparatus for controlling the operation of a valve in an internal combustion engine. The apparatus includes a lost motion sleeve having a stepped generally tubular body with a larger diameter portion terminating in a first open end and a smaller diameter portion terminating in a second open end opposite the first end. The second end is adapted to slidingly receive a stem piston in contact with a stem end of an engine valve. The apparatus also includes a generally cylindrical rocker piston having a lower end and an upper end. The lower end of the rocker piston is slidingly disposed in the first end of the sleeve. The apparatus also includes a clamping means being selectively activated for retaining the sleeve. The clamping means is preferably an electrically actuated piezoelectric or magnetostrictive clamping block. A generally non-compressible fluid, such as engine oil, is introduced in the larger diameter portion of the sleeve. Alternatively, the lower end of the lost motion sleeve receives a lash adjustment piston in addition to the rocker piston for providing lash adjustment for the engine valve actuation. By placing a lash adjustment piston in the lost motion sleeve, the lash adjustment function can be advantageously removed from the rocker arm pivot, simplifying the rocker arm pivot, as compared to the prior art.

When a stem piston contacting a stem end of an engine valve is inserted into the second end of the lost motion sleeve and the clamping means is activated to retain the sleeve, force applied to the upper end of said rocker piston will move the rocker piston toward the second end of the lost motion sleeve and act upon the valve stem through the fluid causing the valve to move. When the clamping means is not activated, the force will act upon the lost motion sleeve through the hydraulic fluid, causing the lost motion sleeve to move relative to the valve stem and prevent a portion of the force acting upon the valve stem from exceeding a predetermined amount required to move the valve.

Alternatively, because electrically actuated piezoelectric or magnetostrictive clamping blocks generally produce a very short stroke, the apparatus includes a multiplier assembly for multiplying the stroke of the clamping block in order to produce a useful clamping device. The multiplier assembly includes a large piston that is moved by the clamping block, which will drive a volume of hydraulic fluid. The volume of hydraulic fluid moves a smaller piston a distance that is longer by the amount of the piston area ratio and provides a clamping force to the lost motion sleeve.

Unlike prior art cylinder deactivation devices, such as those using locking pins in lifter devices, the present invention can be advantageously locked in a multitude of positions. The friction clamping allows the lost motion sleeve to be stopped in any position in its allowed stroke, and at any time during its motion. This allows the engine controller to select which portion of the cam motion will be transmitted from the cam lobe to the valve.

In operation, if the cam motion is initiated with the lost motion sleeve locked, the valve will begin to move with the initial ramp, following the cam. If at any time the controller unlocks the lost motion sleeve, any further motion of the cam will be absorbed by the motion of the lost motion sleeve against its spring, and the valve spring will drive the valve closed, also displacing oil by motion of the lost motion sleeve. In this way the engine valve motion will have controlled reduction of lift and shortening of duration, with opening timing left in its original location.

Similarly, if the cam motion is started with the lost motion sleeve unlocked, the initial motion of the cam will displace oil that moves the sleeve, leaving the engine valve stationary. If at any time on the opening ramp or flank of the cam the engine controller locks the lost motion sleeve with the clamp, the engine valve will begin to move at that time, traveling the remaining stroke left from that point on the cam. This strategy produces a valve motion with a later opening time, an earlier closing time, shorter duration, and reduced valve lift from the conventional full motion of the cam. This version of the valve motion would have its center point at the same timing as that ground on the camshaft.

The engine design strategy using the present invention would be to design a camshaft with the largest desired valve lift and duration required at any operating point, and would be reduced as dictated by the engine controller to be optimum at all other operating points. The timing could be altered to some extent by the present invention, and complete control of timing could be accomplished by the addition of a conventional cam phasing device.

The present invention has several advantages over the prior art in lost motion hydraulic systems. The most important of these advantages is the reduced losses associated with the hydraulics of the system. Since the hydraulic fluid is displaced without passing through passages and solenoid valves, the losses associated with these parts are largely eliminated. Prior art lost motion devices also required a separate accumulator to recover the hydraulic energy, and in the present invention the lost motion device and the accumulator are one component, reducing cost and complexity.

Another limitation of prior art lost motion devices has been their inability to produce the equivalent of cam ramp motion, accelerating and decelerating the valves slowly enough to prevent valve bounce, wear, noise, and high Hertz stresses. In the present invention, since the force generated by the clamping block can be varied by altering the applied signal, and since the clamping block is a friction device, the actuation of the lost motion sleeve and, consequently, the motion transmitted to the valve, can be done gradually by the relatively slow application of the frictional clamping force. This provides a clutch effect to reduce acceleration to acceptable levels.

The present invention allows engine valves to be rapidly and selectively disabled or allows engine valves to operate normally. A number of advantageous fuel economy, emissions, and fuel efficiency strategies can be accomplished by this selection of valve operation.

DESCRIPTION OF THE DRAWINGS

The above, as well as other advantages of the present invention, will become readily apparent to those skilled in the art from the following detailed description of the preferred embodiments when considered in the light of the accompanying drawings in which.

DESCRIPTION OF THE PREFERRED EMBODIMENTS

Figure 1:
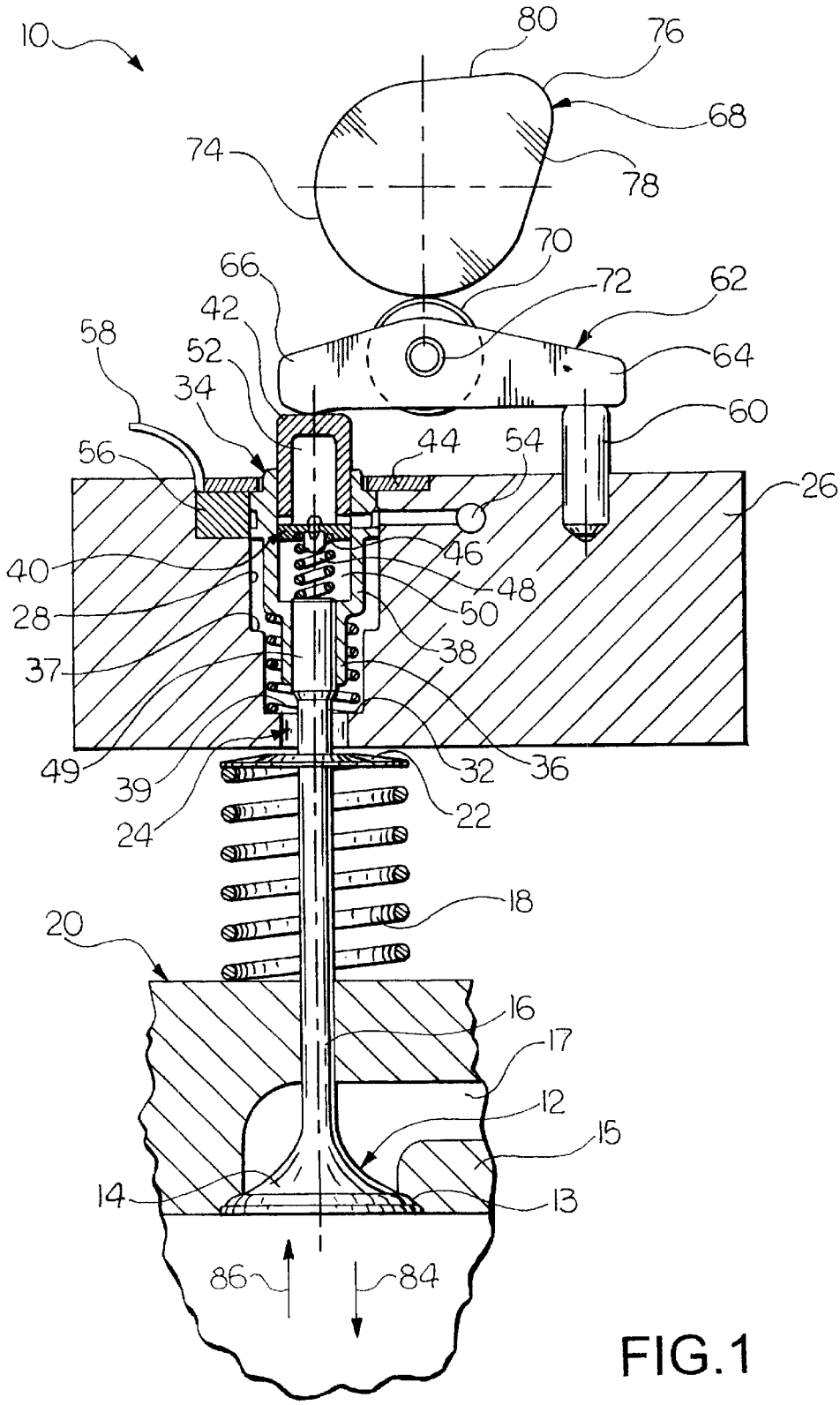
FIG. 1 is a cross-sectional view of an apparatus in accordance with the present invention shown mounted to an overhead cam and rocker valvetrain.

Referring now to FIG. 1, an apparatus for controlling the operation of a valve in an internal combustion engine is indicated generally at 10. The control apparatus 10 is associated with a valve 12 to be controlled, such as an intake valve or exhaust valve of an internal combustion engine. The valve 12 includes a generally mushroom-shaped head 14 having an elongated cylindrical valve stem 16 extending therefrom. The valve head 14 is biased against a valve seat 13 by a helical compression valve spring 18 that is disposed about the stem 16. The valve seat 13 is formed in a cylinder head 15 and connect a port 17, such as an intake or an exhaust port, formed in the cylinder head to a combustion chamber 19 of the engine below the valve head 14. A lower end of the spring 18 abuts a surface 20 of the cylinder head 15 and an upper end of the valve spring abuts a retainer 22 attached to an upper portion of the valve stem 16. The upper portion of the valve stem 16 extends upwardly beyond the retainer 22 into a stepped generally cylindrical aperture 24 formed in a casting 26, such as a cam carrier casting. The aperture 24 is defined by a stepped generally cylindrical interior wall 28 of the casting 26 having an upper annular shoulder 30, connecting a larger diameter upper portion with an intermediate diameter central portion, and a lower annular shoulder 32, connecting the central portion with a smaller diameter lower portion.

The aperture 24 slidably receives a stepped generally tubular lost motion sleeve 34 having a first lower portion 36 of a first diameter and a second upper portion 38 of a second diameter, the second diameter being larger than the first diameter. The lower portion 36 and the upper portion 38 of the lost motion sleeve 34 are connected by an annular shoulder 37. The lost motion sleeve 34 is biased upwardly by a helical compression sleeve return spring 39 disposed about the lower portion 36 and retained between the lower shoulder 32 of the wall 28 and the shoulder 37 of the sleeve. A force required to compress the sleeve return spring 39 is much less than a force required to compress the valve spring 18. An open end of the upper portion 38 of the lost motion sleeve 34 slidably receives a generally disk-shaped lash adjustment piston 40 below an inverted generally cup-shaped rocker piston 42. The lost motion sleeve 34 is retained in the aperture 24 by a retaining ring 44 attached to an upper surface of the casting 26 and having a central opening through which the piston 42 extends.

The lash adjustment piston 40 includes a center bore receiving a check ball 46 biased by a helical check valve compression spring 48 abutting a stem piston 49 resting on an upper end of the valve stem 16. The ball 46 and the spring 48 are disposed in an upper chamber 50 formed in the upper portion 38 of the lost motion sleeve 34 in which chamber the pistons 40 and 42 can reciprocate. The rocker piston 42 includes a cylindrical bore 52 formed therein that is in fluid communication, in the closed position of the valve 12 as shown, through the wall of the upper portion 38 with a pressurized fluid supply passage 54 extending through the casting 26. The fluid supply passage 54 supplies a hydraulic fluid, such as engine lubricating oil, to the bore 52 in the rocker piston 42 and to the upper chamber 50 of the lost motion sleeve 34 through the center bore of the lash adjustment piston 40. The check ball 46 and the check valve spring 48 of the lash adjustment piston 40 allow the hydraulic fluid to flow from the bore 52 to the upper chamber 50 such when the valve 12 is in the closed position, the lash adjustment piston 40 takes up any clearance in the valvetrain.

Alternatively, the lash adjustment piston 40 is not used and the bore 52 is in direct fluid communication with the upper chamber 50 of the rocker piston 42.

A clamping block 56 is disposed in the casting 26 in a wall of the upper portion of the aperture 24 adjacent an exterior surface of the upper portion 38 of the lost motion sleeve 34. The clamping block 56 is preferably a piezoelectric or magnetostrictive device that is connected to, and provided a control signal by, a control device (not shown) such as an engine controller through a control cable 58. The control signal can be varied between an activation signal and a deactivation signal. The activation signal causes the deactivated clamping block 56 to increase in horizontal length and move into contact with the exterior surface of the upper portion 38 providing a high radial force against the lost motion sleeve 34. The clamping block 56 moves the lost motion sleeve 34 against the wall 28 of the aperture 24 adjacent the passage 54 thereby clamping and preventing axial movement of the sleeve 34. The deactivation signal causes the activated the clamping block 56 to decrease in horizontal length thereby releasing from engagement with the upper portion 38 and releasing the sleeve 34 permitting axial movement thereof. The increase and decrease in horizontal length of the clamping block 56 is relatively small and requires close spacing of the lost motion sleeve 34 relative to the wall 28 and the facing surface of the block 56.

A fixed pivot point 60 is attached to and extends upwardly from the upper surface of the casting 26. The pivot point 60 is preferably a post, pin, or similar member able to withstand the forces induced by the camshaft rotation. A rocker arm 62 having a fixed end 64 and a pivot end 66 is mounted at the fixed end 64 on the fixed pivot point 60. A lower surface of the pivot end 66 of the rocker arm 62 contacts an upper end surface of the rocker piston 42. The arm 62 rocks on the pivot point 60 under the influence of an overhead cam lobe 68. A rocker roller 70 is rotatably attached to the rocker arm 62 via a bearing connection 72 that is intermediate the fixed end 64 and the pivot end 66. A peripheral exterior surface of the rocker roller 70 contacts an exterior surface of the cam lobe 68. The exterior surface of the cam lobe 68 includes a valve closed base circle portion 74 and a peak portion 76 having a first valve opening ramp portion 78 and a second valve closing ramp portion 80 extending therebetween. The overhead cam lobe 68 is attached to a camshaft (not shown).

In operation, the camshaft rotates the overhead cam lobe 68 about a central axis in a direction shown by an arrow 82. Alternatively, the camshaft rotates the cam lobe 68 in the opposite direction and the functions of the ramps 78 and 80 are reversed. When the first ramp portion 78 of the cam lobe 68 contacts the rocker roller 70, a force is applied to move the pivot end 66 of the rocker arm 62 in a downward valve opening direction as depicted by an arrow 84. The downwardly moving pivot end 66 of the rocker arm 62 causes the rocker piston 42 and the lash adjustment piston 40 to move in the valve opening direction 84. The movement of the pistons 40 and 42 increases the pressure on the hydraulic fluid in the chamber 50 of the sleeve 34.

If the control device is providing the activation signal to the clamping block 56, the sleeve 34 remains stationary and the valve 12 is moved in the valve opening direction by the pressured hydraulic fluid in the chamber 50, the downward movement compressing the valve spring 18 and opening the valve by moving the valve head 14 away from the valve seat 13. After passing the peak portion 76 of the cam lobe 68, the second ramp portion 80 contacts the rocker roller 70 and the pivot end 66 of the rocker arm 62 moves upwardly in a valve closing direction as depicted by an arrow 86. The movement of the pivot end 66 of the rocker arm 62 and the rocker piston 42 is aided by the force of the valve spring 18 as it returns to its rest position closing the valve head 14 against the valve seat 13 when the base circle portion 74 of the cam lobe 68 contacts the rocker roller 70.

If the control device is providing the deactivation signal to the clamping block 56 when the pressure on the hydraulic fluid pressure in the chamber 50 is increased, the pressured hydraulic fluid acts on the stepped surface 37 moving the sleeve 34 in the valve opening direction 84. The movement of the lost motion sleeve 34 in the valve opening direction 84 compresses the sleeve return spring 39. The valve 12 does not move because the moving lost motion sleeve 34 maintains the volume of the chamber 50 during the downward motion of the rocker arm 62 and the rocker piston 42 which prevents the pressure on the upper end of the valve stem 16 from increasing high enough to compress the valve spring 18 and move the valve 12 from the seat 13.

After passing the peak portion 76, the rotation of the cam lobe 68 causes the second ramp portion 80 to contact the rocker roller 70 moving the pivot end 66 of the rocker arm 62 upwardly and, in turn, allowing the rocker piston 42 and the sleeve 34 to move in the valve closing direction 86. The upward movement of the sleeve 34 and the rocker piston 42 is aided by the force of the sleeve return spring 39 as it returns to its rest position. The valve lost motion sleeve 34 and the rocker piston 42 return to the rest position when the base circle portion 74 of the cam lobe 68 contacts the rocker roller 70.

The apparatus 10 can be used with a pushrod valvetrain (not shown), wherein the rocker arm 62 is pivotally mounted at or about the bearing connection 72. The pivot point 60 and the roller 70 are eliminated. The cam 68 is positioned below the rocker arm 62 and actuates a pushrod (not shown) abutting the lower surface of the end 64 and reciprocating the valve 12. Alternatively, the apparatus 10 can also be used with a direct acting overhead cam valvetrain (not shown) wherein the outer surface of the cam lobe 68 contacts the upper surface of the rocker piston 42 directly, rather than through the rocker roller 70 and the rocker arm 62.

Figure 2:
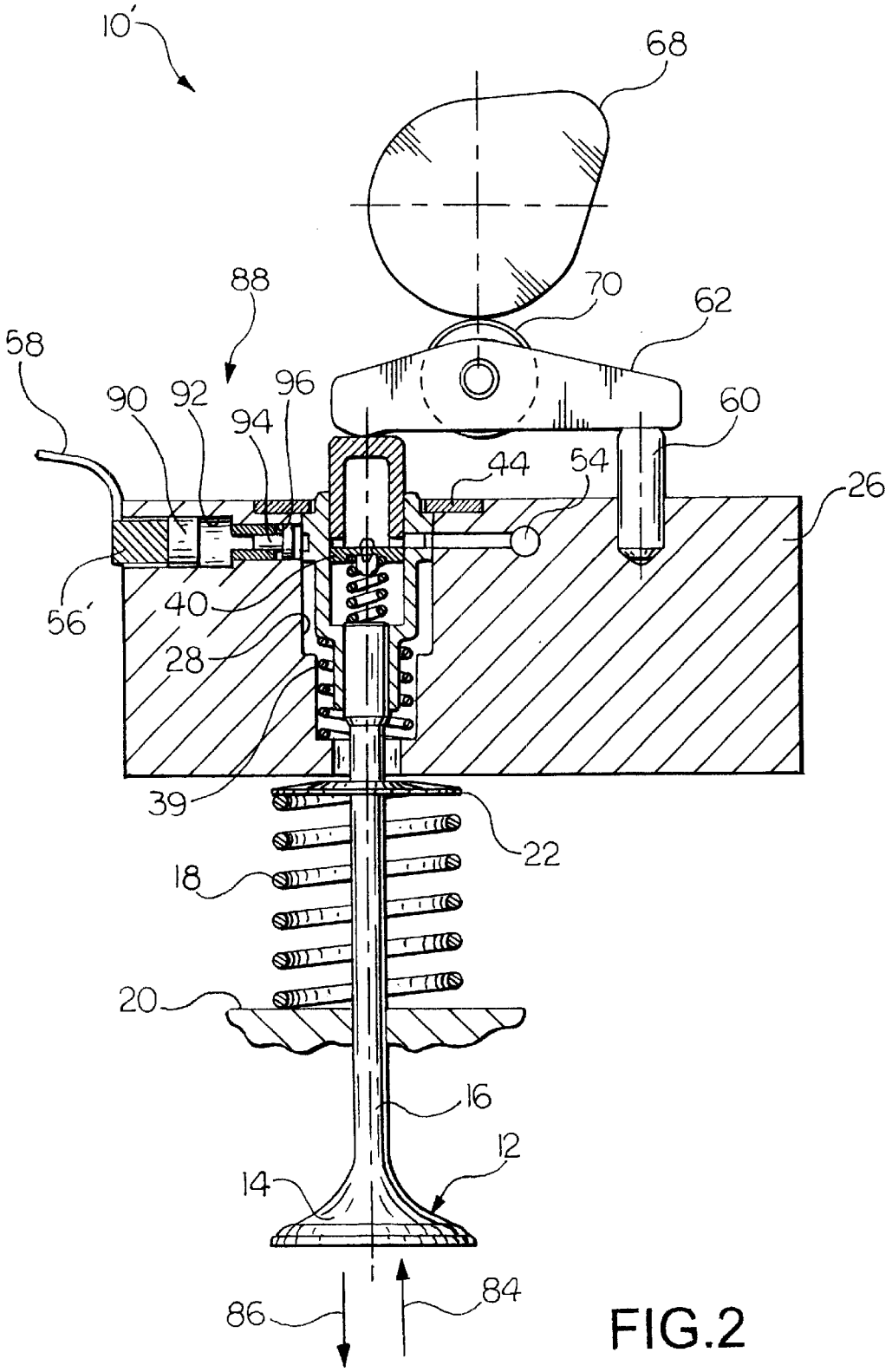
FIG. 2 is a cross-sectional view of an alternative embodiment of an apparatus in accordance with the present invention shown mounted to an overhead cam and rocker.

Referring now to FIG. 2, an alternative embodiment of the control apparatus is indicated generally at 10'. As noted above, clamping blocks, such as the clamping block 56 shown in FIG. 1, generally have an extremely short stroke and, therefore, it may be desirable to multiply the stroke to produce a useful clamping force. This can be accomplished with the valve control apparatus 10' including a multiplier assembly, indicated generally at 88, actuated by a modified clamping block 56'. The multiplier assembly 88 includes a multiplier piston 90 attached to the clamping block 56'. The multiplier piston 90 is slidably received in a multiplier piston cylinder 92, which is in fluid communication with the pressurized fluid supply passage 54 and thus receives the hydraulic fluid. A clamping piston 94, having a second diameter that is smaller than a first diameter of the multiplier piston 90, is slidably received in a clamping piston cylinder 96. The clamping piston 94 is adjacent the exterior surface of the lost motion sleeve 34 and the cylinders 92 and 96 are in fluid communication.

The clamping block 56' is preferably a piezoelectric or magnetostrictive device, and is connected to and provided the control signal by a control device (not shown) through the control cable 58. The activation control signal causes the clamping block 56' to increase in horizontal length moving the multiplier piston 92 toward the clamping piston 94 by a similar distance. The volume decrease in the fluid in the cylinder 92 is accommodated in the cylinder 96 by a proportional increase in the distance moved. Thus, the clamping piston 94 moves an increased distance to the side of the lost motion sleeve 34 to clamp it against the wall 28. The deactivation signal causes the clamping block 56' to decrease in horizontal length thereby releasing the pressure applied through the piston 90 and permitting the clamping piston 94 to release the sleeve 34. In operation, the apparatus 10' controls the deactivation of the valve 12 in the same manner as the apparatus 10 shown in FIG. 1.

Figure 3:
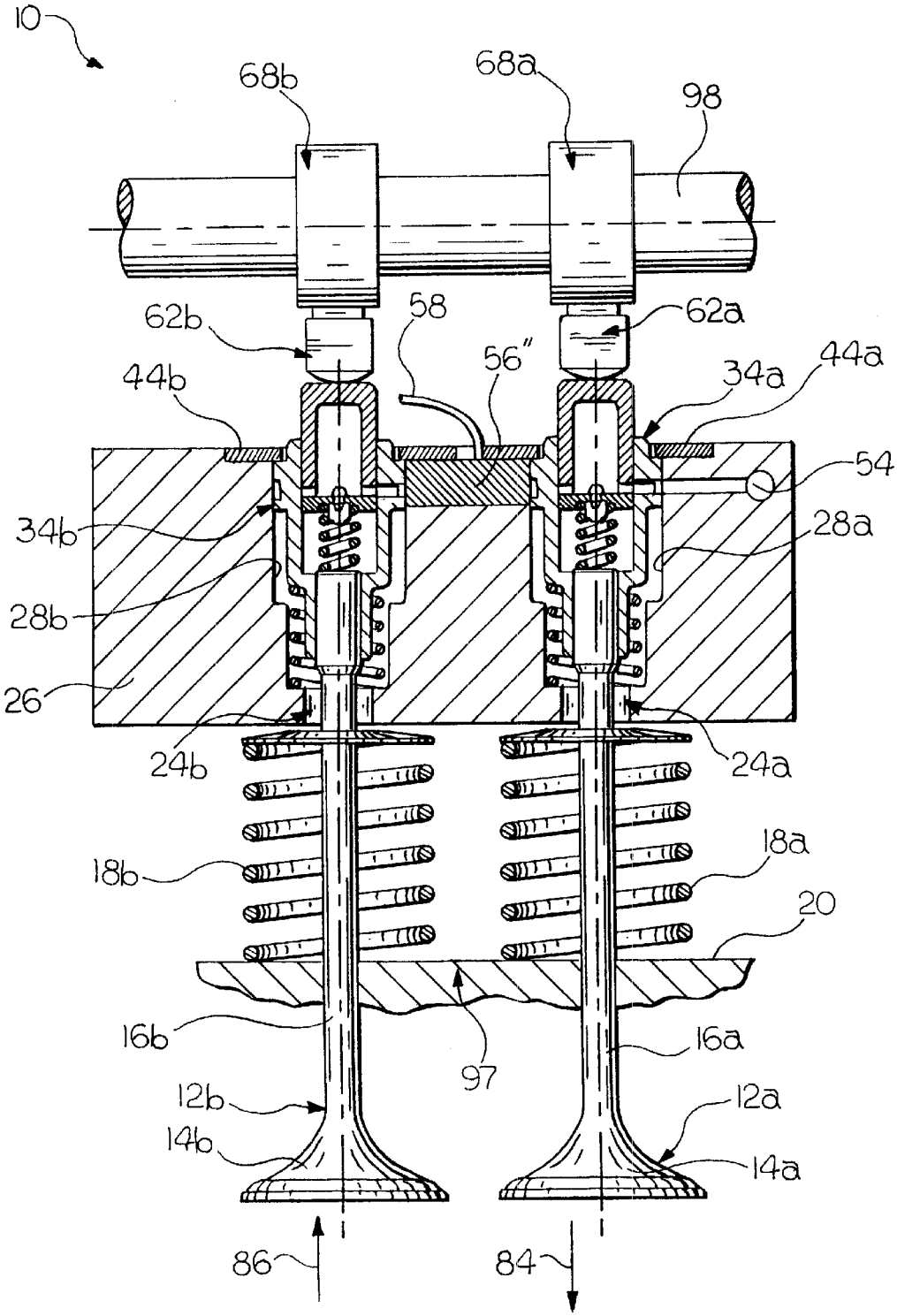
FIG. 3 is a cross-sectional view of another alternative embodiment of an apparatus in accordance with the present invention shown mounted to a multi-valve engine valvetrain.

Referring now to FIG. 3, another alternative embodiment of the valve control apparatus is indicated generally at 10". FIG. 3 illustrates a multivalve valvetrain, such as a pair of intake valves or exhaust valves, indicated generally at 97 and corresponds to a view as if taken from the left side of FIG. 1. The valvetrain 97 includes a first valve 12*a* and a second valve 12*b* having identical to and performing the same function as the valve 12 shown in FIGS. 1 and 2. Accordingly, the components associated with the first valve 12*a* having the same function as the components associated with the valve 12 are designated with the same reference numeral and a lowercase "a", and the components associated with the second valve 12*b* having the same function as the components associated with the valve 12 are designated with the same reference numeral and a lowercase "b".

The valvetrain 97 includes a camshaft 98 having a cam lobe 68*a* and a cam lobe 68*b* attached thereto. A clamping block 56" is disposed in a space in the casting 26 between and adjacent to a first lost motion sleeve 34*a* and a second lost motion sleeve 34*b*. The clamping block 56" is preferably a piezoelectric or magnetostrictive clamping block, and is connected to and provided the control signal by a control device (not shown) through the control cable 58. The activation control signal causes the clamping block 56" to increase in horizontal length in both directions against the lost motion sleeves 34*a* and 34*b*, moving the lost motion sleeves 34*a* and 34*b* radially outwardly against the walls 28*a* and 28*b* of the apertures 24*a* and 24*b*. The deactivation signal causes the clamping block 56" to decrease in horizontal length releasing the clamping pressure.

In operation, the apparatus 10" controls the operation of the valves 12*a* and 12*b* in the same manner as the apparatus 10 shown in FIG. 1 and the apparatus 10' shown in FIG. 2 control the operation of the valve 12. When the control device provides an activation signal to the clamping block 56", the lost motion sleeves 34*a* and 34*b* remain stationary and allow the valves 12*a* and 12*b* to open. Conversely, when the control device provides a deactivation signal to the clamping block 56", the lost motion sleeves 34*a* and 34*b* reciprocate within the apertures 24*a* and 24*b* and do not allow the valves 12*a* and 12*b* to open.

Figure 4:
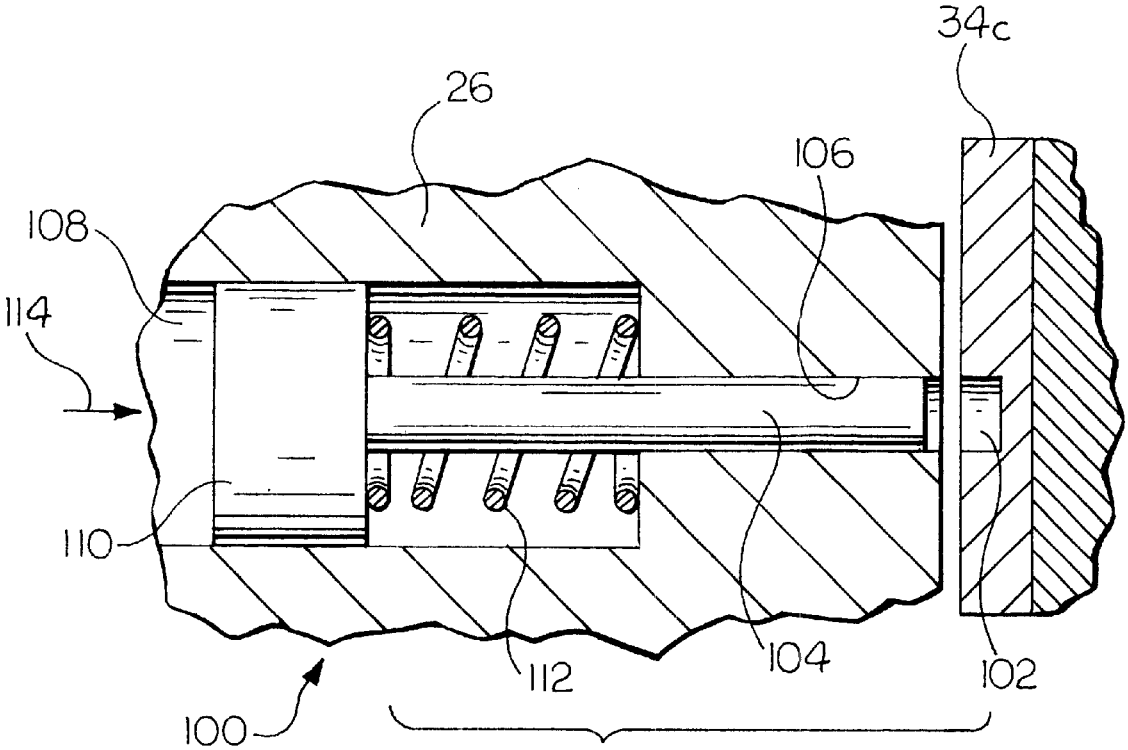
FIG. 4 is a schematic cross-sectional view of an alternative embodiment of a clamping means used in the apparatus according to the present invention.

The clamping blocks 56, 56' and 56" are representative of any suitable clamping means used to clamp or hold the lost motion sleeve 34. For example, there is shown in FIG. 4 a clamping means 100 mounted in the casting 26 for preventing movement of a lost motion sleeve 34*c*. Only a side wall portion of the sleeve 34*c* is shown having a cavity 102 formed in an exterior surface thereof. The clamping means 100 includes a pin 104 slidably received in an aperture 106 formed in the casting 26. One end of the aperture 106 is open to the exterior of the sleeve 34*c* adjacent to the cavity 102 and an opposite end is open to a cylinder 108 formed in the casting 26. A piston 110 is slidably received in the cylinder 108 and is attached to the pin 104. A spring 112 is positioned in the cylinder 108 to bias the piston 110 and the pin 104 away from the cavity 102. When pressured hydraulic fluid is supplied to the cavity 108 on the side of the piston 110 opposite the pin 104, the piston 110 and the pin 104 are moved in the direction of an arrow 114 to compress the spring 112 and engage the pin with the cavity and prevent vertical movement of the lost motion sleeve 34*c*. Removal of the fluid pressure from the piston 110 permits the spring 112 to return the piston 110 and the pin 104 to the positions shown in FIG. 4 thereby disengaging the pin from the cavity 102 and permitting movement of the sleeve 34*c*.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for controlling the deactivation of a movable valve comprising:

a lost motion sleeve having a generally tubular body with a smaller diameter first portion and a larger diameter second portion connected by a shoulder, said first portion having an open end adapted to slidingly receive a valve;

a rocker piston slidingly disposed in an open end of said second portion of said sleeve;

a clamping means positioned adjacent an exterior surface of said second portion of said sleeve and being selectively activated for preventing movement of said sleeve; and a generally non-compressible fluid retained in said second portion of said sleeve whereby when a valve is inserted into said open end of said first portion of said sleeve in a valve closed position, said fluid is trapped between the valve and said rocker piston, and when said rocker piston is moved toward the valve and said clamping means is activated, the valve is moved relative to said sleeve to a valve opened position, and when said rocker piston is moved toward the valve and said clamping means is not activated, said sleeve is moved relative to the valve and the valve remains in the valve closed position.

2. The apparatus according to claim 1 wherein said rocker piston is hollow with an open end facing said shoulder of said sleeve.

3. The apparatus according to claim 2 including a lash adjustment piston positioned in said second portion of said sleeve adjacent said open end of said rocker piston, said lash adjustment piston including check valve means permitting fluid to flow from an interior of said rocker piston through said lash adjustment piston.

4. The apparatus according to claim 1 including a return spring acting on said sleeve to move said sleeve when said rocker piston is moved away from the valve.

5. The apparatus according to claim 1 wherein said clamping means is formed of one of a piezoelectric material and a magnetostrictive material.

6. The apparatus according to claim 1 wherein when said sleeve is positioned for slidable movement in an aperture having a wall and said clamping means is activated, said clamping means engages said sleeve and forces said sleeve into contact with the wall of the aperture.

7. The apparatus according to claim 6 wherein said clamping means includes a clamping block and a multiplier means positioned between said clamping block and said sleeve whereby when said clamping means is activated, said clamping block increases in length by a first predetermined amount and said multiplier means moves a second predetermined amount greater than said first predetermined amount.

8. The apparatus according to claim 7 wherein said multiplier means includes a larger diameter multiplier cylinder in fluid communication with a smaller diameter clamping cylinder, a multiplier piston slidably retained in said multiplier cylinder and moved by said activated clamping block, a clamping piston slidably retained in said clamping cylinder for engagement with said sleeve, and a quantity of fluid retained by said cylinders between said pistons.

9. The apparatus according to claim 1 wherein said clamping means includes a slidable pin selectively movable into and out of contact with said sleeve.

10. The apparatus according to claim 9 wherein said clamping means includes hydraulic actuation means for moving said slidable pin into contact with said sleeve.

11. An apparatus for controlling the deactivation of a pair of movable valves comprising:

A pair of lost motion sleeves each having a generally tubular body with a smaller diameter first portion and a larger diameter second portion connected by a shoulder, each said first portion having an open end adapted to slidingly receive a valve;

a pair of rocker pistons each slidingly disposed in an open end of said second portion of an associated one of said sleeves;

a clamping means positioned adjacent an exterior surface of said second portion of each of said sleeves and being selectively activated for preventing movement of said sleeves; and a generally non-compressible fluid retained in said second portion of each of said sleeves whereby when a separate valve is inserted into said open end of said first portion of each of said sleeves in a valve closed position, said fluid is trapped between each of the valves and an associated one of said rocker pistons, and when each of said rocker pistons is moved toward the associated valve and said clamping means is activated, the associated valve is moved relative to said associated sleeve to a valve opened position, and when each of said rocker pistons is moved toward the associated valve and said clamping means is not activated, said associated sleeve is moved relative to the associated valve and the associated valve remains in the valve closed position.

12. An apparatus for controlling the deactivation of one of an internal combustion engine intake valve and exhaust valve comprising:

a lost motion sleeve having a generally tubular body with a smaller diameter first portion and a larger diameter second portion connected by a shoulder, said first portion having an open end adapted to slidingly receive a valve;

a rocker piston slidingly disposed in an open end of said second portion of said sleeve;

a clamping means positioned adjacent an exterior surface of said second portion of said sleeve and being selectively activated for preventing movement of said sleeve; and a generally non-compressible fluid retained in said second portion of said sleeve whereby when a stem of an engine valve is inserted into said open end of said first portion of said sleeve in a valve closed position, said fluid is trapped between the stem and said rocker piston, and when said rocker piston is moved toward the stem and said clamping means is activated, the valve is moved relative to said sleeve to a valve opened position, and when said rocker piston is moved toward the stem and said clamping means is not activated, said sleeve is moved relative to the valve and the valve remains in the valve closed position.

13. The apparatus according to claim 12 wherein said rocker piston is hollow with an open end facing said shoulder of said sleeve and including a lash adjustment piston positioned in said second portion of said sleeve adjacent said open end of said rocker piston, said lash adjustment piston including check valve means permitting fluid to flow from an interior of said rocker piston through said lash adjustment piston.

14. The apparatus according to claim 12 including a return spring acting on said sleeve to move said sleeve when said rocker piston is moved away from the stem.

15. The apparatus according to claim 12 wherein said clamping means is formed of one of a piezoelectric material and a magnetostrictive material.

16. The apparatus according to claim 12 wherein said clamping means includes a clamping block and a multiplier means positioned between said clamping block and said sleeve whereby when said clamping means is activated, said clamping block increases in length by a first predetermined amount and said multiplier means moves a second predetermined amount greater than said first predetermined amount.

17. The apparatus according to claim 12 wherein said clamping means includes a slidable pin selectively movable into and out of contact with said sleeve.

18. The apparatus according to claim 17 wherein said clamping means includes hydraulic actuation means for moving said slidable pin into contact with said sleeve.

19. The apparatus according to claim 12 including a stem piston slidably received in said open end of said first portion of said sleeve for contacting an upper end of the valve stem.

* * * * *